US005303771A

United States Patent [19]

Des Champs

[11] Patent Number: 5,303,771

[45] Date of Patent: Apr. 19, 1994

[54] DOUBLE CROSS COUNTERFLOW PLATE TYPE HEAT EXCHANGER

[75] Inventor: Nicholas H. Des Champs, Fincastle, Va.

[73] Assignee: Des Champs Laboratories Incorporated, Natural Bridge Station, Va.

[21] Appl. No.: 992,790

[22] Filed: Dec. 18, 1992

[51] Int. Cl.[5] ..... F28F 3/10

[52] U.S. Cl. ..... 165/165; 165/166

[58] Field of Search ..... 165/165, 166

[56] References Cited

U.S. PATENT DOCUMENTS

| | | | |
|---|---|---|---|
| 1,833,166 | 11/1931 | Lucke | 165/166 |
| 3,165,152 | 1/1965 | Jones | 165/166 |
| 4,040,804 | 8/1977 | Harrison | 165/165 |
| 4,140,175 | 2/1979 | Darm | 165/165 |
| 4,314,607 | 2/1982 | Des Champs | 165/166 |
| 4,475,589 | 10/1984 | Mizuno et al. | 165/166 |
| 4,616,695 | 10/1986 | Takahashi et al. | 165/166 |
| 4,749,032 | 6/1988 | Rosman et al. | 165/166 |

FOREIGN PATENT DOCUMENTS

| | | | |
|---|---|---|---|
| 2546450 | 4/1976 | Fed. Rep. of Germany | 165/166 |
| 403940 | 4/1974 | U.S.S.R. | 165/166 |
| 938088 | 9/1963 | United Kingdom | 165/166 |
| 1498621 | 1/1978 | United Kingdom | 165/165 |
| 2063450 | 6/1981 | United Kingdom | 165/166 |

OTHER PUBLICATIONS

Des Champs Laboratories, Inc., Thermo Z® High Temperature Heat Exchangers, 1991, Bulletin No. TZX-991/5.

*Primary Examiner*—John Rivell
*Assistant Examiner*—L. R. Leo
*Attorney, Agent, or Firm*—Donavon Lee Favre

[57] ABSTRACT

A double cross counterflow heat exchanger of the continuous plate type is formed of a continuous sheet of heat conductive material folded upon itself on fold regions in opposite directions alternately to define a plurality of substantially parallel, mutually spaced sheet portion, substantially each sheet portion thereby being located between first and second adjacent sheet portions with the fold regions being located at the lengthwise ends of each sheet. Each sheet portion has a pair of edge sections perpendicular to the fold which joins two sheets, the portions of which edge sections, of the two sheets, most distant from the joining fold are sealed together to define a fluid flow channel, each of the channels having first and second fluid transmitting openings located at the sides of each channel, and a third fluid transmitting opening located at the end of each channel opposed to the fold sealing the opposite end of each channel.

3 Claims, 5 Drawing Sheets

DOUBLE CROSS COUNTERFLOW PLATE TYPE HEAT EXCHANGER

BACKGROUND OF THE INVENTION

This invention relates generally to heat exchangers and more particularly to heat exchangers of the plate-type, ie., wherein thermal energy is transferred between two currents of moving fluid through a plate formed of heat conductive material.

Although in the following description reference will be made to air-to-air heat exchangers wherein thermal energy is transferred from a warm air current to a cooler one, it is understood that the invention is applicable to heat transfer between a pair of any fluids. The present invention has its greatest applicability in the area of air-to-air heat exchangers which are intended to recover energy from a waste or stale air steam and transfer it to an incoming stream of fresh air.

There are presently available many types of air-to-air heat exchangers which function to recover thermal energy from stale or waste air and transfer it to incoming fresh or make up air. For example, heat exchangers of the rotating wheel regenerative type, the heat pipe type, the run around coil loop type, the shell-and-tube and the plate-type are all known and each such type of heat exchanger has certain peculiar characteristics which tend to make it more readily adaptable to a particular application than the other devices. Of all these types of heat exchangers, the plate-type heat exchanger is acknowledged as being the most simple in construction as well as being one of the more efficient and easier to maintain types of heat exchangers. The present invention relates to such plate-type heat exchangers.

Plate type heat exchangers can generally be divided into two categories. More particularly a first category can be termed "discrete plate exchangers". Such discrete plate heat exchangers generally are formed of a plurality of adjacent, individual sheets or plates formed of a heat conductive material and which extend generally parallel to each other between the open ends of a housing so that a plurality of adjacent channels are defined between pairs of adjacent plates The second category of plate-type heat exchangers can be termed "continuous sheet exchangers" wherein the thermal transfer core is generally formed of a continuous sheet of heat conductive material which is folded upon itself in opposite directions alternately to define a plurality of spaced, parallel sheet portions. In this manner a plurality of channels are formed between adjacent sheet portions.

Continuous sheet heat exchanger have several distinct advantages relative to discrete plate exchangers. More particularly, by forming the thermal transfer core of a single sheet of conductive material, significant economies in manufacturing are achieved relative to discrete plate exchangers which as mentioned earlier require the manufacture of a plurality of separate plates. The continuous nature of the thermal transfer core of a single continuous sheet heat exchanger reduces the extent of sealing required in the manufacture of the heat exchanger. Further, it is possible in continuous sheet exchangers to achieve the proper spacing between adjacent pairs of sheet portions through the provision of appropriately formed spacing dimples in the continuous sheet. A particularly favorable arrangement of such spaced dimples is illustrated in U.S. Pat. No. 4,043,388.

However, conventional plate-type heat exchangers of both the discrete and continuous type have certain disadvantages. Of perhaps the greatest significance, currently available discrete and continuous counter flow plate-type heat exchangers require significant amounts of energy to force the two currents of fluids through the heat exchangers. The resistance to flow is due to restricted sized openings in the heat exchangers. The restricted sized openings is a result of heat exchanger designs. One current of fluid enters one end of a heat exchanger and exhausts at an opposing end. A second current of fluid enters the opposing end, flows in counterflow direction and exits at the end the first fluid enters. A particularly efficient design of a counterflow heat exchanger is disclosed in U.S. Pat. No. 4,314,607, the disclosure of which is hereby incorporated by reference. In the typical counterflow heat exchanger, two sides of the heat exchanger are blocked so that fluids cannot enter and the end areas are each divided into halves, one half for entering fluid and one half for exiting fluid. Other heat exchanger designs include the UI, LU, ZI, UU, LL, UI, LU, ZI, UU, LL and X flow. The letters designate the flow pattern through the plate type heat exchanger. Only the X flow utilizes four open sides of the heat exchanger for free air flow, but being a cross flow heat exchanger, is less efficient than a counterflow heat exchanger. Plate type heat exchangers having the various flow patterns are disclosed in the Thermo Z® High Temperature Heat Exchangers brochure available from Des Champs Laboratories Incorporated (DLI), Box 220, Douglas Way, Natural Bridge Station, VA 24579.

SUMMARY OF THE INVENTION

The present invention is directed to a plate type heat exchanger wherein two ends of a heat exchanger are each dedicated to unrestricted outflow of one fluid stream, cutting resistance to flow by half due to area increase, and by another significant amount due to less turbulence due to lower velocities. This is assuming comparable volumes of fluid through the heat exchanger of the present invention and the heat exchangers of the prior art.

The heat exchanger of the present invention is designed so that fluid can enter the sides and exit the ends, leaving both sides, except for a narrow separator, and both ends open for unrestricted fluid flow. Flow patterns through each of the channels of the heat exchanger of the present invention can be reversed, but for simplicity of description all conceivable flow patterns will not be discussed simultaneously. The designations of front, back, ends, sides, length and width designations is also arbitrary to simplify the present description. For the purpose of description, it will be assumed that the heat exchanger is slightly longer than it is wide. Preferably the heat exchanger is longer than it is wide, because of the necessity of two side openings. The increased length of the openings decreases the entrance resistance to air flow, conserving energy. One of the lengthwise ends will be designated a front end or an end, the other lengthwise end will be designated a back end or an end. Only one air stream flows through the channels terminating at each end. The sides which are the lengthwise dimension of the heat exchanger, have a series of flow channels for two air streams each. These will be arbitrarily designated as fresh air intake channels and exhaust air intake channels. Each fresh air intake channel is formed by a sheet section above the channel, a fold forming a closed end of the channel, and the sheet section extending from the bottom of the fold below the channel. At preferably half of the distance from the fold to a lengthwise opening in the channel, the sheet section above the channel is sealed to the sheet section below the channel. By this manner two fresh air intake ducts are provided in each fresh air intake channel, one on each side of each channel. Fresh air enters the fresh air intake ducts on the two sides of the fresh air intake channel, makes a 90 degree turn, flows parallel to the two seals, sealing the top sheet portion of the channel to the bottom sheet portion of the channel, and exits at the end of the channel between the spacing between the top sheet portion and the bottom sheet portion in the unfolded longitudinal end of the channel.

The folds on the sheet portions forming the exhaust air channels are on opposite longitudinal ends of the heat exchanger from the folds on the sheet portions forming the intake air channels. Also inherent in the folding of a sheet, the folds form alternate channels.

Each exhaust air channel is formed by a sheet section above the channel, a fold forming a closed end of the channel, and the sheet section extending from the bottom of the fold below the channel. At preferably half of the distance from the fold to a lengthwise opening in the channel, the sheet section above the channel is sealed to the sheet section below the channel. By this manner two exhaust air intake ducts are provided in each exhaust air channel, one on each side of each channel. Exhaust air enters the exhaust air intake ducts on the two sides of the exhaust air channel, makes a 90 degree turn, flows parallel to the two seals, sealing the top sheet portion of the channel to the bottom sheet portion of the channel, and exits at the end of the channel between the spacing between the top sheet portion and the bottom sheet portion in the unfolded longitudinal end of the channel. The exhaust air enters the heat exchanger in cross flow heat exchange relationship with the fresh air, then flows countercurrent to the direction of the fresh air, and then assumes a cross flow heat exchange direction with the fresh intake air where the fresh intake air enters the side ducts of the fresh air channels.

Instead of a single sheet being folded back and forth upon itself to form a heat exchanger, a series of flat parallel plates could be used. Adjacent sheets could be sealed at alternate ends to form the equivalent of a folded sheet. In which case the heat exchanger would comprise a plurality of substantially parallel, mutually spaced sheets, each sheet in combination with a next adjacent sheet forming a fluid passageway. End seals would be located between one end of a first sheet and an adjacent end of an adjacent sheet. A second end seal would be located between the opposite end of the adjacent sheet and an adjacent end of the next adjacent sheet. The pattern would be repeated of end seals at alternate opposite ends of the plurality of sheets. Side seals would seal adjacent sheets against fluid passage along both edges of adjacent sheets. The side seal would be spaced from the end seal and extend to the opposed longitutudinal end of each sheet to form an opening at each side of each fluid passageway, whereby a series of alternate counterflow fluid passageways would be formed throughout the plurality of spaced sheets.

The structure formed by the separate parallel plates, each plate sealed at an alternate ends to an adjacent plate would be the same as that created by a folded sheet except for the end sealing structure. Of course the top and bottom sheet of either type of either structure would only be joined to one adjacent sheet.

DESCRIPTION OF THE PREFERRED EMBODIMENTS

Figure 1:
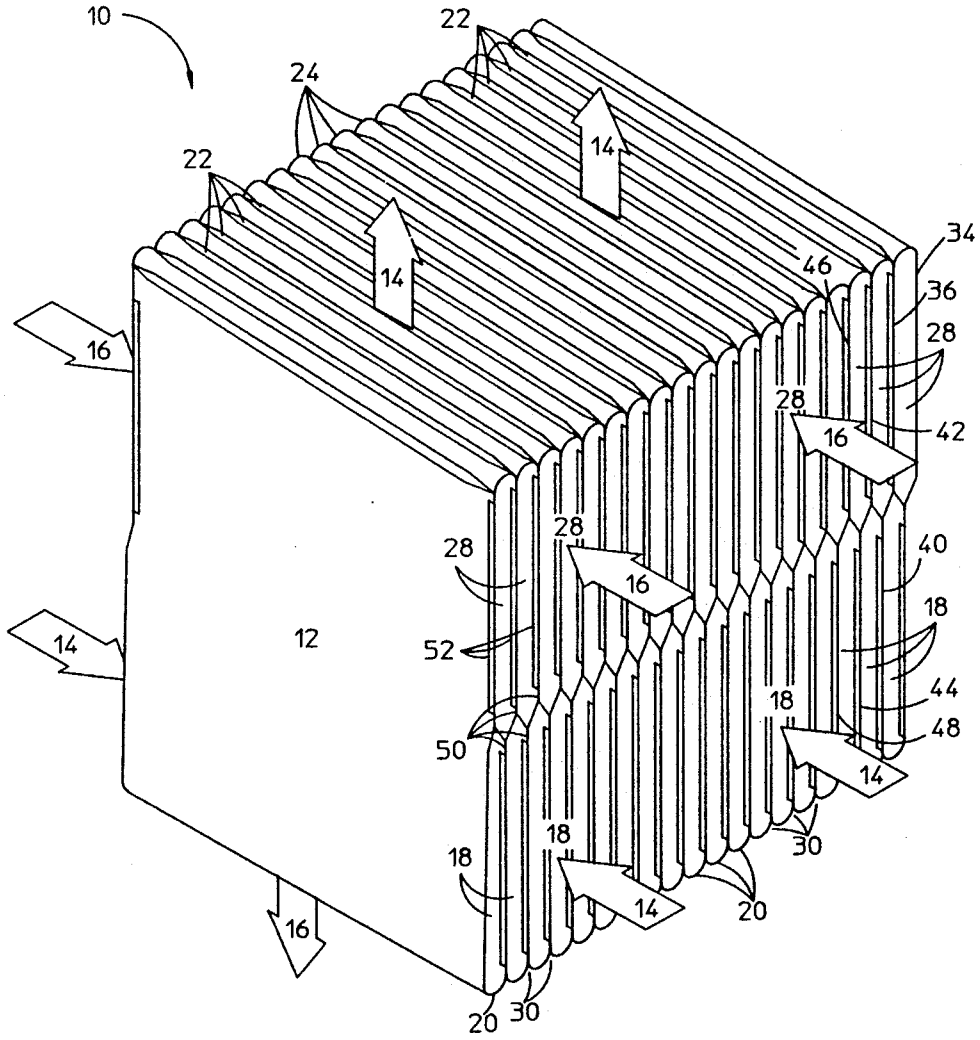
FIG. 1 is a perspective view in outline of a continuous sheet heat exchanger according to the present invention showing the channels formed by the folding and sealing of a single folded sheet.
Figure 3:
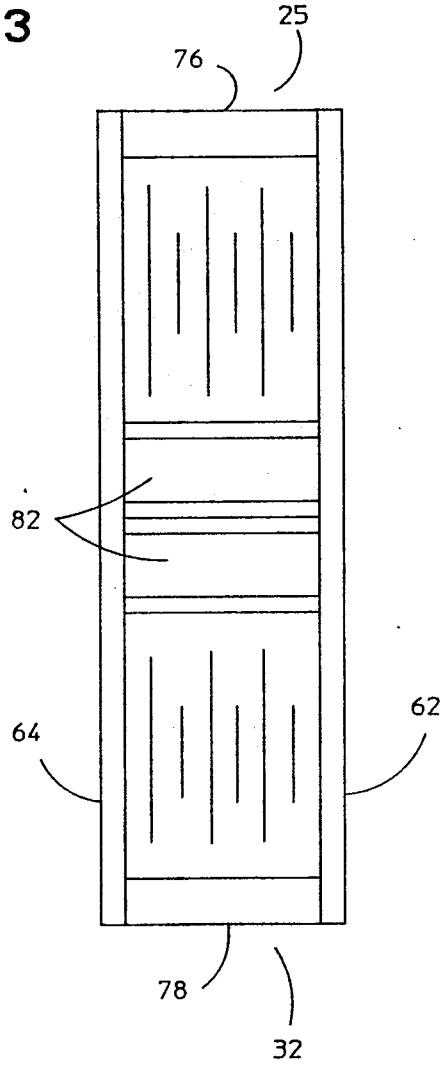
FIG. 3 is a side view of the housing of FIG. 2.
Figure 2:
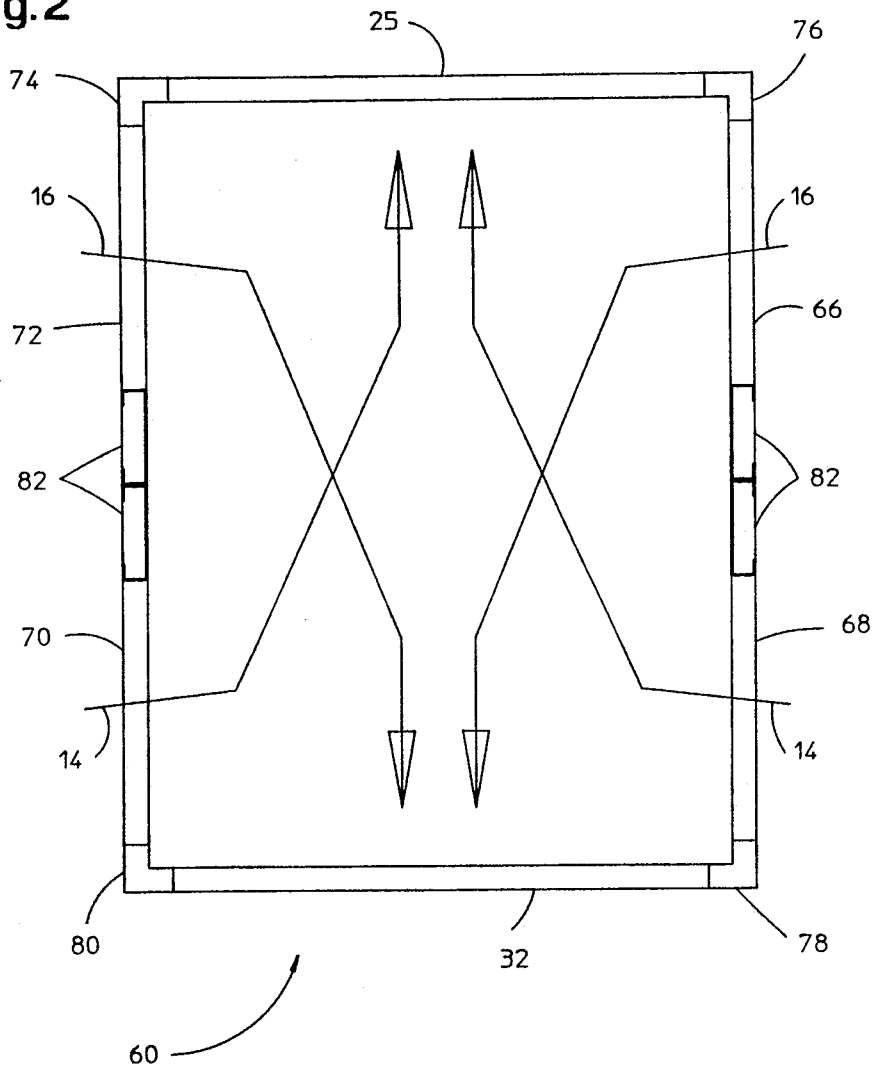
FIG. 2 is a sectional top view of the housing for the heat exchanger of FIG. 1 showing the direction and path of air flowing through the housing.

Referring now to the drawings wherein like reference characters designate identical or corresponding parts throughout the several views and more particularly to FIGS. 1–4, the continuous sheet heat exchanger of the present invention, generally designated 10 formed of a continuous sheet of heat conductive material 12. The heat exchanger is manifolded in a manner such that two air flows, e.g., exhaust air flow 14 and fresh air flow 16 pass in double cross counterflow relation through the heat exchanger 10. See FIGS. 1 and 2 for the flow pattern. More particularly, exhaust air flow 14 enters the heat exchanger 10 through fluid transmitting openings 18 in the side sections of the heat exchanger adjacent end folds 20 and exits from the heat exchanger through third fluid transmitting openings 22 adjacent end folds 24 at housing end 25 (FIGS. 1 and 2). On the other hand, the fresh air flow 16 enters the heat exchanger 10 through third and fourth fluid transmitting openings 28 in the side sections of heat exchanger 10 adjacent end folds 24 (FIGS. 1 and 2) and exits through fifth fluid transmitting openings 30 at housing end 32.

As explained in greater detail below, each respective air flow 14, 16 flows through a respective set of channels formed by adjacent sheet portions 34, 36, 40, 42 44, 46 and 48 of the continuous sheet of heat conductive material 12, the channels of each set alternating with each other so that heat is transferred from the warmer to the cooler air flow through the heat conductive material.

Figure 4:
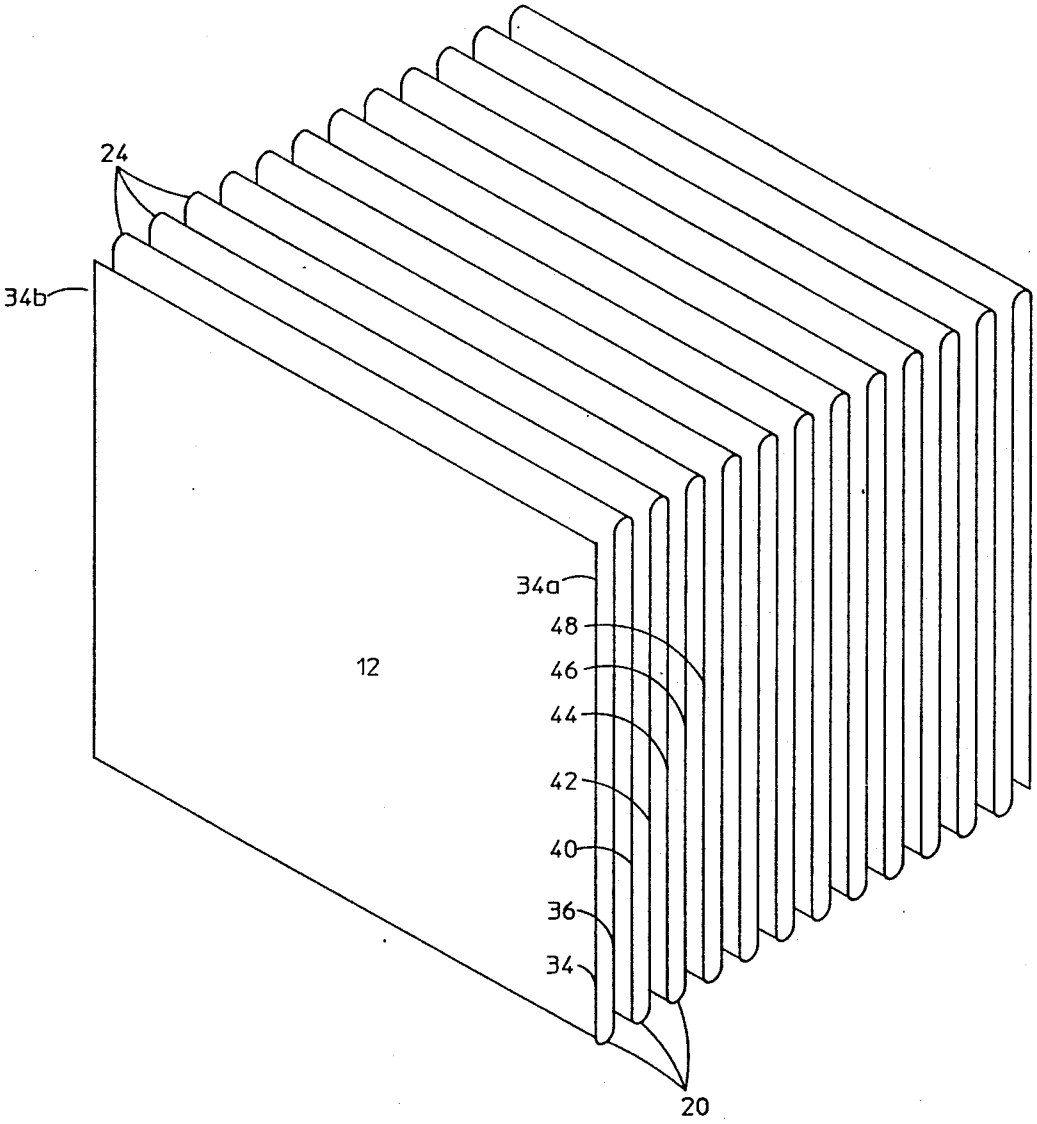
FIG. 4 is a fragmentary perspective view of a continuous sheet of heat conductive material utilized in the manufacture of the heat exchanger, illustrated in an intermediate manufacturing configuration.

Referring to FIG. 4, a continuous sheet 12 of heat conductive material utilized for the thermal transfer is illustrated during an intermediate manufacturing step. More particularly, the continuous sheet 12 comprises a thin sheet of heat conductive material such as aluminum having a thickness of 0.01 inch. The sheet 12 is folded upon itself in opposite directions alternately along fold regions 20 and 24 which extend transversely between first and second longitudinally extending edges 50, an 52. In this manner a plurality of substantially parallel sheet portions 34, 36, 40, 42, 44, and 48 are defined between the left and right fold regions 24 and 20. Each sheet portion (34–48) terminates at first and second free edge sections so that, referring to FIG. 4 for example the sheet portion designated 34 has a first free edge section 34*a* and a second free edge section 34*b* (FIG. 4).

In order to provide appropriate spacing between adjacent sheet portions, the continuous sheet 12 is formed with a multiplicity of raised and depressed dimples which are appropriately provided so that upon folding the continuous sheet 12 each dimple will be aligned with and abut against a corresponding dimple in an adjacent sheet portion so that the pairs of adjacent sheet portions will be properly spaced from each other. In this connection. reference is made to U.S. Pat. No. 4,043,388 which discloses a particularly advantageous arrangement for such dimples. The depth of draw of the dimples is equal to about one half the desired spacing between the adjacent sheet portions and in one embodiment where the spacing between adjacent sheet portions i.e., the width of the fluid flow passage defined between the adjacent sheet portions, is 0.2 inches; the depth of the dimples is approximately 0.1 inches.

Figure 6:
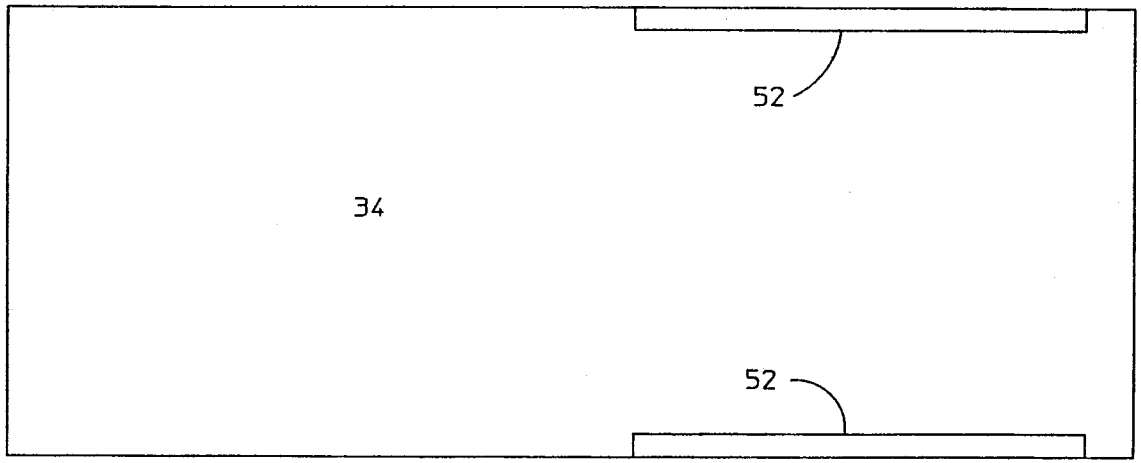
FIG. 6 is a top view of FIG. 5.
Figure 5:
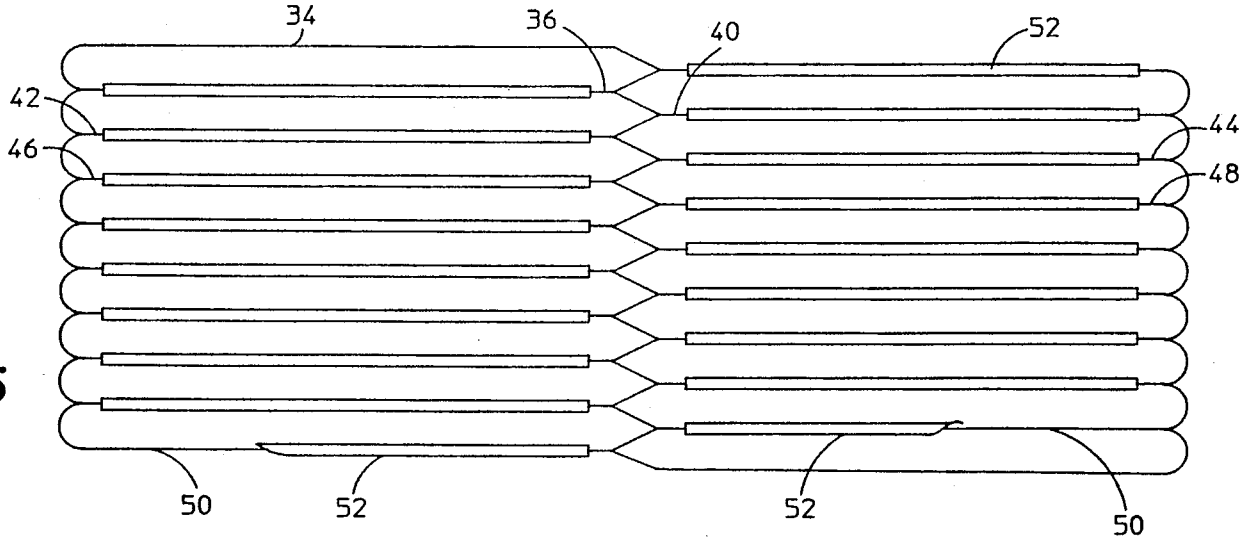
FIG. 5 is a front view partially broken away of the central portion of one edge region of the heat exchanger illustrating the sealing arrangement, the remainder of the drawing being in outline.
Figure 7:
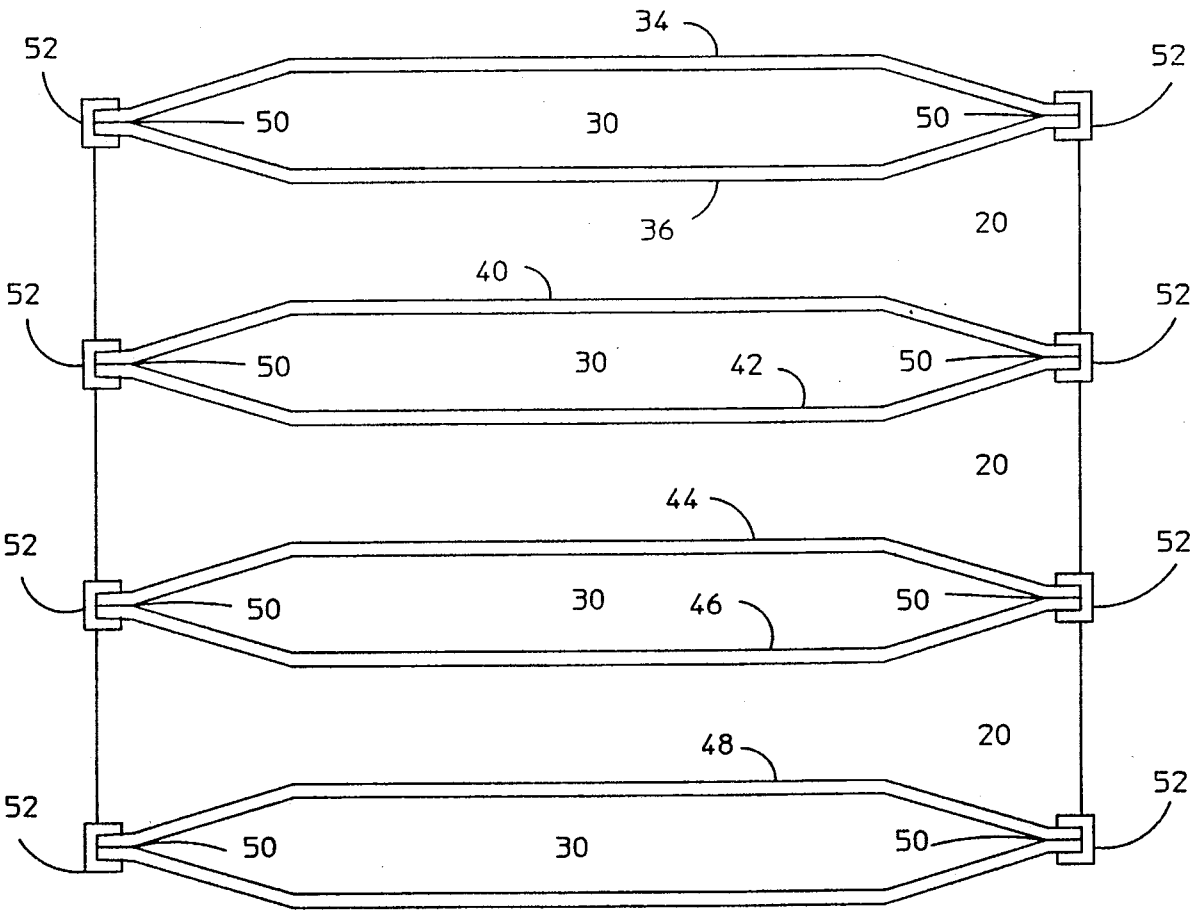
FIG. 7 is a right hand end view of FIG. 5 showing the clips used to join section of adjacent sheets to form channels.

Referring now to FIGS. 5–7, the manifolding of the continuous sheet 12 will now be described. Each sheet portion 34, 36, 40, 42, 44, and 48 is located adjacent one or two other sheet portions. Thus for example sheet portion 34 is located adjacent sheet portion 36. According to the invention, the two side edges extending from approximately the center of the length of sheet portion 34 to the ends of the sheet portions most remote from fold 24 are sealed to the corresponding edges of sheet 36 to form a mating edge 50. In the illustrated preferred embodiment, this is carried out by means of foil clips 52 each being folded over on itself to clamp the corresponding edge section portions to each other. Preferably, a sealant material is applied to the edge sections prior to affixing the foil sealing clips 52 thereto.

In a similar fashion, the side edges of sheet portion 36 from the center of the sheet portion to the end of the sheet portion most remote from fold 20 are joined to the corresponding edges of sheet portion 40.

This sealing arrangement is repeated for each of the sheet portions, 42, 44, 46, and 48. By this construction, alternate pairs of adjacent sheet portions define a first set of flow channels each of which has two side openings 18 and an end opening 22, and a second set of flow channels each of which has two side openings 28 and one end opening 30.

For example, referring to FIGS. 5–7, the adjacent sheet portions 34 and 36 define between them a fluid flow channel through which fresh intake air flow 16 will enter through the first and second fluid transmitting openings 28 at each open side adjacent folds 24 and from which the flow 16 will exit through the third fluid transmitting opening 30.

As noted above, a second set of channels are defined by the other alternate pairs of adjacent sheet portions, these second channels opening at fourth and fifth fluid transmitting openings 18 located in the side of heat exchanger 10 adjacent folds 20. Thus each channel in the second set is defined by a pair of adjacent sheet portions, eg. channels formed between pairs of sheet portions, pairs 36 and 40, pairs 42 and 44, pairs 46 and 48. The side edges of the adjacent pairs of sheet portions have their side edges which are adjacent the corresponding end openings 30 sealed to form mating edges 50. The mating edges are then covered with the foil clip 52. In this manner a second set of channel which alternate with the channels of the first set is defined. An exhaust air flow 14 is directed in double cross counterflow relationship though side openings 18 in both sides of heat exchanger 10, through the length of the heat exchanger 10 and exhausting through openings 22. The warm exhaust gas heats the incoming fresh air by heat exchange.

It is thus seen that this manifolding technique when used in a continuous sheet heat exchanger provides a heat exchanger wherein two sets of alternating fluid flow channels are defined, each set of channels opening at the sides of the heat exchanger and exiting at an end of the heat exchanger. With both sides and both ends of the heat exchanger open for fluid flow there is a minimum resistance to flow, and a minimum of energy required to provide flow. The thermal efficiency of the heat exchanger is also enhanced because of the countercurrent component of the heat exchange flow.

After having considered the above-described construction of the continuous sheet heat exchanger of the present invention, the assembly of the housing 60 will now be described. Housing 60 is defined by a pair of opposed top and bottom walls 62, 64. These housing walls are preferably formed of metallic sheet stock such, for example, as steel or aluminum and are attached to a frame at their edges by welding, threaded fasteners, rivets or the like. Reinforcing channels are preferably provided on the housing walls. Prior to completing the construction of the housing, the heat exchanger 10 is located in the interior thereof. More particularly, the heat exchanger 10 comprising the continuous sheet which has been manifolded in the manner described above is located within the housing such the upper and lower fold regions are located contiguous with the top and bottom walls 62 and 64 of the housing respectively so that they extend longitudinally therein in a manner such that the first and second edge sections of the sheet portions are located substantially at the first and second open ends 25, 32 of housing 60. The drawings are merely illustrative of the invention. The first heat exchanger of the present invention had 28 folds in sheet 12.

In order to prevent cross-contamination of the respective fluid flows in the regions of the housing side openings 66, 68, 70, 72, and the two housing end openings 25, 32, it is preferred to provide certain sealing means in addition to the particular manifolding structure described above, namely the foil clip sealing of adjacent portions of adjacent edge sections. This is accomplished by first placing heat exchanger 10 on the bottom side 64 of housing 60 and affixing the bottom sheet portion of sheet of sheet 12 to the floor or bottom side 64. Room temperature vulcanizable silicone sealant is then liberally applied to the upright corners and the side center sections of the heat exchanger 10. Corner posts 74, 76, 78, 80 and side seals 82 and 84 are then sealed to the heat exchanger with the silicone sealant. The corner posts and side seals are also affixed to the bottom side 64. The top side 62 is then affixed to the upper ends of the corner posts side seals and the upper sheet portion 34 of sheet 12.

What is claimed is:

1. A heat exchanger comprising: a single continuous sheet of heat conductive material having first and second longitudinally extending edges, the sheet being folded upon itself in opposite directions alternately on fold regions which extend between a first fluid passageway and a second fluid passageway and transversely to the longitudinally extending edges to define between the fold regions a plurality of substantially parallel, mutually spaced sheet portions, space between the spaced sheet portions being free of a permanent internal frame which would interfere with heat exchange between the passageways and restrict fluid flow into the passageways, first and second sheet portions having respective upper and lower portions with sealing means along a first longitudinally extending edge section thereof, and second and third sheet portions further having respective lower and upper portions with sealing means along a second longitudinally edge section thereof, the first and second longitudinally extending edge sections being spaced from respective opposed fold regions to produce a series of alternating flow passageways.

2. A heat exchanger comprising a plurality of substantially parallel, mutually spaced sheet portions formed by folding a continuous sheet of heat conductive material upon itself in opposite directions on fold regions which extend between the sheet portions, each sheet portion in combination with a next adjacent sheet portion forming a fluid passageway, and wherein end seals created by fold regions comprise one end seal located between one end of a first sheet and an adjacent end of an adjacent sheet, a second end seal is located between the opposite end of the adjacent sheet and adjacent end of a next adjacent sheet, a repeat of the pattern of end seals at alternate opposite ends of the plurality of sheets, side seals sealing adjacent sheets against fluid passage along both edges of adjacent sheets, the side seals being spaced from the end seals joining the adjacent sheets to form an opening at each side of each fluid passageway, each side opening being sufficiently large so as not to restrict the passage of fluid flowing through each fluid passageway, whereby a series of counterflow fluid passageways are formed throughout the plurality of spaced sheet portions, the heat exchanger being free of an internal frame.

3. A plate type heat exchanger of the continuous sheet type consisting essentially of a continuous sheet of heat conductive material folded upon itself on fold regions in opposite directions alternately to define a plurality of substantially parallel, mutually space sheet portions free of an internal supporting frame, each sheet portion, except terminal sheet portions, thereby being located between first and second adjacent sheet portions with the fold regions being located at a lengthwise end of each sheet portion, except one terminal lengthwise end of each terminal sheet portion, a pair of edge sections on each sheet portion, the edge sections extending from each fold which joins each of two sheet portions, portions of the pair of edge sections most distant from the joining fold are sealed together to define a fluid flow channel, each of the channels having first and second fluid transmitting openings located at the sides of each channel, and a third fluid transmitting opening located at the end of each channel opposed to the fold sealing the opposite end of each channel, whereby one set of fluid transmitting openings are located at one lengthwise end of the heat exchanger, and a second set of fluid transmitting openings are located at an opposite end of the heat exchanger, with the first and second fluid transmitting opening of each channel located on the side of each channel at the opposite end of each channel from the opening at the lengthwise end of each channel resulting in the heat exchanger being capable of primarily counterflow heat exchange the total area of the side fluid transmitting openings being approximately equal to the total area of the openings at the lengthwise ends of each channel whereby the flow of fluid through each passageway is not restricted by the area of the first and second fluid transmitting openings.

* * * * *